US005486799A

United States Patent [19]

Komazaki et al.

[11] Patent Number: 5,486,799

[45] Date of Patent: Jan. 23, 1996

[54] STRIP LINE FILTER AND DUPLEXER FILTER USING THE SAME

[75] Inventors: Tomokazu Komazaki; Katsuhiko Gunji; Kazushige Noguchi; Kunihiro Tanoie, all of Tokyo, Japan

[73] Assignee: Oki Electric Industry Co., Ltd., Tokyo, Japan

[21] Appl. No.: 326,368

[22] Filed: Oct. 20, 1994

Related U.S. Application Data

[62] Division of Ser. No. 56,626, May 4, 1993, abandoned.

[30] Foreign Application Priority Data

May 8, 1992 [JP] Japan ..... 4-116159

[51] Int. Cl.[6] ..... H01P 5/12; H01P 1/202; H01P 1/203

[52] U.S. Cl. ..... 333/134; 333/204; 333/205; 333/206; 333/207

[58] Field of Search ..... 333/126, 129, 333/134, 202–207, 219, 222, 223

[56] References Cited

U.S. PATENT DOCUMENTS

| | | | |
|---|---|---|---|
| 4,768,003 | 8/1988 | Kawakami et al. | 333/206 X |
| 4,987,393 | 1/1991 | Yorita et al. | 333/202 |
| 5,130,683 | 7/1992 | Agahi-Kesheh et al. | 333/203 |
| 5,160,905 | 11/1992 | Hoang | 333/203 X |
| 5,293,141 | 3/1994 | Kohayashi et al. | 333/134 X |

FOREIGN PATENT DOCUMENTS

| | | | |
|---|---|---|---|
| 0336255 | 10/1989 | European Pat. Off. . | |
| 2675638 | 10/1992 | France | 333/202 DB |
| 55702 | 4/1985 | Japan | 333/202 DB |
| 61-193501 | 8/1986 | Japan . | |
| 61-201501 | 9/1986 | Japan . | |
| 157401 | 7/1987 | Japan | 333/202 DB |
| 33201 | 2/1990 | Japan | 333/203 |
| 2234399 | 1/1991 | United Kingdom . | |

*Primary Examiner*—Paul Gensler
*Attorney, Agent, or Firm*—Steven M. Rabin

[57] ABSTRACT

A compact, high performance strip line filter which may be made thinner than a dielectric filter having comparable performance characteristics. The strip line filter includes a rectangular box-shaped, dielectric block having parallel grooves, formed in a front face with a predetermined spacing therebetween, the grooves extending from a top face to a bottom face of the block. A thin film outer conductive layer covers the side faces, the back face, and the bottom face. Resonator conductors, each formed of a thin film of conductive material, cover the respective surfaces of the grooves and are connected to the outer conductor. According to a further aspect, a substrate, with capacitor formed thereon, opposes a face of the dielectric block to provide capacitive coupling. The capacitors may be arranged to provide attenuation poles at finite frequencies. In accordance with another aspect, such strip line filters are used as the transmitting and receiving filters of a duplexer filter.

22 Claims, 17 Drawing Sheets

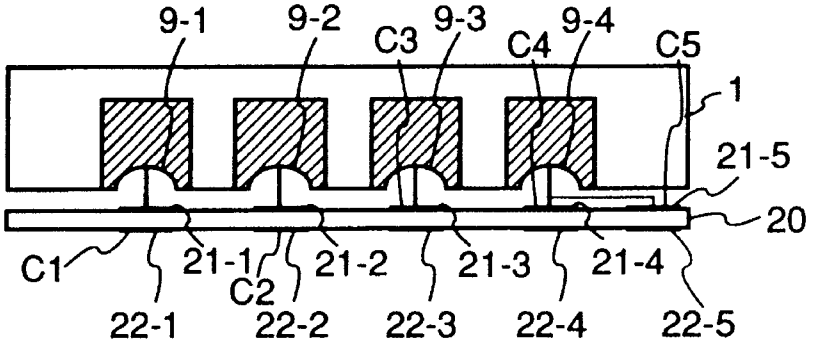
FIG.10B
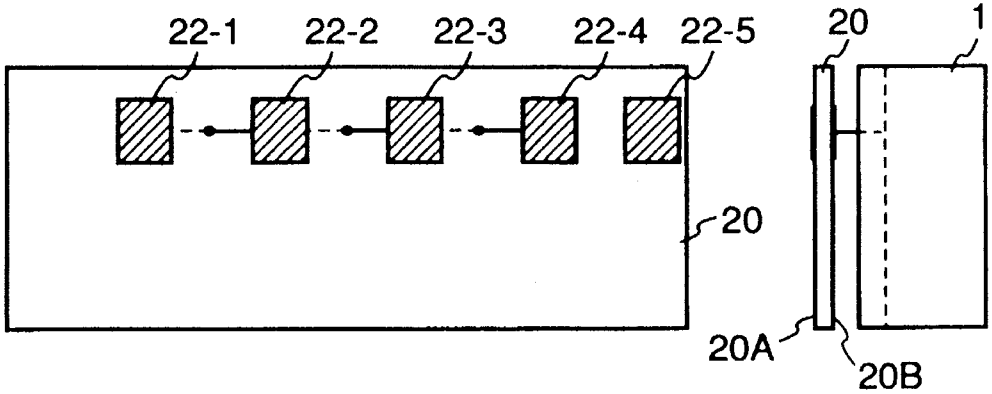
FIG.10A
FIG.10C

FIG.15B
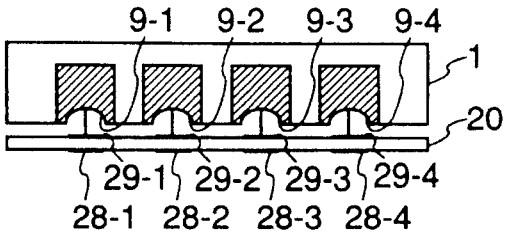
FIG.15A
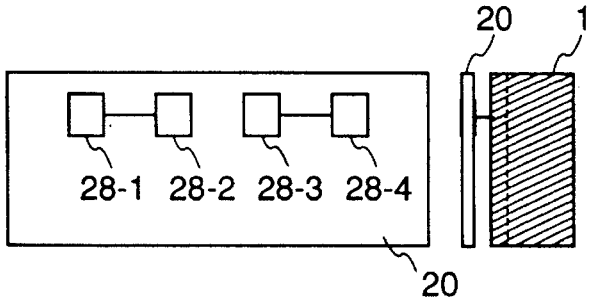
FIG.15C
FIG.16
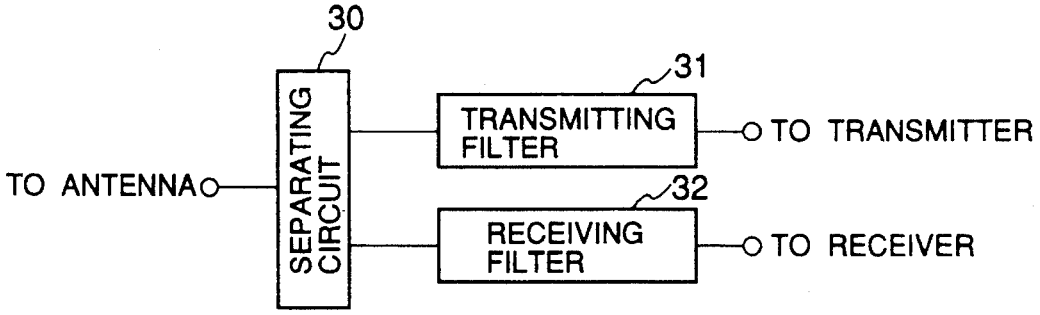

STRIP LINE FILTER AND DUPLEXER FILTER USING THE SAME

CROSS-REFERENCE TO RELATED APPLICATIONS

This application claims priority under 35 U.S.C. 119 based on Japanese patent application Ser. No. 04-116159, filed May 8th, 1992, the entire disclosure of which is incorporated herein by reference. Furthermore, this application is a Division of application Ser. No. 08/056,626, filed May 4, 1993, now abandoned.

BACKGROUND OF THE INVENTION

1. Field of the Invention

The invention relates to a compact, reliable, high performance, strip line filter, and to a duplexer filter including such a strip line filter.

2. Description of Related Art

Simply constructed and compact, high performance dielectric filters are known for use in mobile telecommunication systems, such as portable telephone systems which operate in the microwave frequency band. Such a known dielectric filter is formed with a unitary, rectangular box-shaped dielectric block which is provided with conductive electrodes, for example metal plating that covers the front, back, bottom and left and right side faces. A row of cylindrical holes passes through the body of the dielectric block, from the bottom face to the top face. Cylindrical inner conductors, forming dielectric resonators, are arranged on the walls of the holes. On the top face, conductive resonance frequency adjusting electrodes are laid out in parallel spaced relation, so as to surround and be connected to the upper ends of the respective inner conductors. The metal plating on the bottom face surrounds, and is connected to, the lower ends of the inner conductors. Input and output pins, surrounded by insulating discs at their upper ends, are inserted into the end holes at opposite ends of the row, for connecting the filter to an external circuit.

The dimensions of the above-described conventional dielectric filter are critical to the quality factor Q of the resonators, and thus the performance of the filter. Therefore, if the width of the filter is reduced as part of an effort to produce a more compact telecommunication apparatus, the Q of the resonators is reduced.

SUMMARY OF THE INTENTION

An object of the invention is to provide an improved strip line filter, which realizes a thinner size while maintaining high performance.

Another object of the invention is to provide a duplexer filter using such a strip line filter.

The foregoing objects may be accomplished with a strip line filter, including a unitary, rectangular box-shaped dielectric block, with a plurality of parallel grooves, formed in a front face with a predetermined spacing. The grooves extend from a top face to a bottom face. An outer conductor, formed of a thin film conductive material, covers side faces, a back face, and a bottom face. A plurality of resonator conductors, each formed of a thin film of conductive material, cover the respective surfaces of the grooves and are connected to the outer conductor. The result is a strip line filter having a high quality factor Q and a considerably reduced width, when compared to a dielectric filter of the prior art.

In accordance with another aspect of the invention, the strip line filter further includes resonance frequency adjusting electrodes formed on the top face of the dielectric block. The electrodes are connected to the upper ends of the respective resonator conductors, and are disposed adjacent to the outer conductor so as to produce a reactance coupling. According to a further aspect, a capacitive coupling is provided by capacitors on a substrate which opposes a face of the dielectric block.

In accordance with still another aspect of the invention, such strip line filters are used as the transmitting and receiving filters in a duplexer filter.

BRIEF DESCRIPTION OF THE DRAWINGS

The above and other objects and features of the invention will be apparent to those skilled in the art from the following detailed description of preferred embodiments thereof when considered in conjunction with the accompanied drawings, in which:

FIGS. 10A to 10C are respective top, front and side views of a strip line filter according to the invention, with a separate substrate beating capacitors for coupling the resonators.

FIGS. 15A to 15C are respective top, front and side views of yet another strip line filter according to the invention;

FIG. 16 is a block diagram of a duplexer filter;

DETAILED DESCRIPTION OF THE PREFERRED EMBODIMENTS

Figure 1:
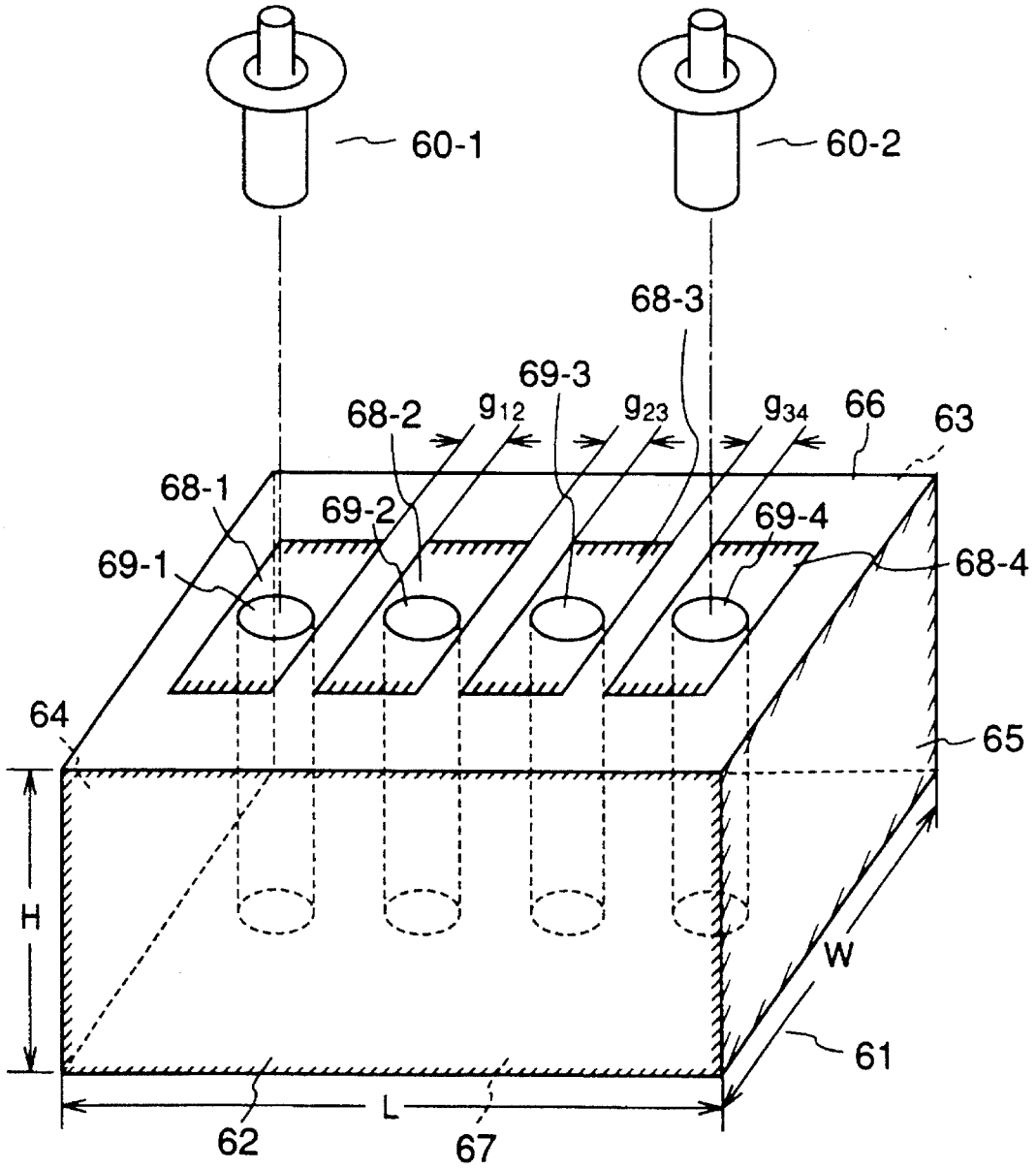
FIG.1 PRIOR ART
FIG. 1 is a perspective view of a conventional dielectric filter.

FIG. 1 illustrates a conventional dielectric filter. The filter includes a unitary, rectangular box-shaped dielectric block 61, having length L, width W, and height H. Conductive electrodes, formed by, for example, by metal plating, cover surfaces of a front face 62, a back face 63, left and right side faces 64, 65, and a bottom face 67. Conductive resonance frequency adjusting electrodes 68-1 to 68-4 are laid out in parallel with respective spaces g12, g23, g34 therebetween, on a top face 66. Cylindrical inner conductors 69-1 to 69-4 are arranged on the walls of four parallel holes extending through the block between the top and bottom faces 66, 67, so as to penetrate the electrodes 68-1 to 68-4 on the top face and penetrate the metal plating on the bottom face. Thus, the inner conductors 69-1 to 69-4 are electrically connected, at their opposite ends, to the resonance frequency adjusting electrodes 68-1 to 68-4, and to the bottom face electrode. The inner conductors function as dielectric resonators. In order to connect the dielectric filter to an exterior circuit, an input pin 60-1 and an output pin 60-2, each surrounded by an insulating disc, are respectively inserted into the dielectric resonator 69-1 and dielectric resonator 69-4 at their respective top ends.

Figure 2:
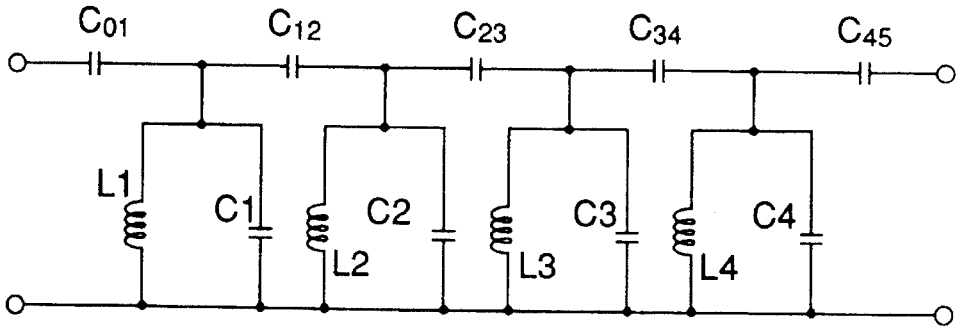
FIG. 2 is a diagram of the equivalent circuit for the dielectric filter of FIG. 1.

FIG. 2 shows an equivalent circuit of the conventional dielectric filter, wherein the distributed inductance and capacitance are represented by lumped constants. Equivalent inductances L1, L2, L3, and L4, arranged in parallel with respective equivalent capacitances C1, C2, C3, and C4, correspond to the dielectric resonators 69-1, 69-2, 69-3, and 69-4, respectively. Capacitors C01, C45 are for coupling the filter with the outer circuit. The capacitor C01 corresponds to the capacitance between the input pin 60-1 and the dielectric resonator 69-1. The capacitor C45 corresponds to the capacitance between the output pin 60-2 and the dielectric resonator 69-4. Coupling capacitors C12, C23 and C34 represent the respective capacitances between the adjacent dielectric resonators. These capacitances are generally determined by the sizes of the spaces g12, g23 and g34 between the resonance frequency adjusting electrodes 68-1, 68-2, 68-3 and 68-4.

Adjustments of the resonance frequency adjusting electrodes 68-1 to 68-4 are performed to adjust the resonance frequency of, and degree of coupling between, the dielectric resonators 69-1 to 69-4. However, the quality factor Q of this circuit is highly dependent on the size of the width W of the block 1. If the dielectric filter, thus constructed with dimensions affording an acceptable Q of 250 or above, is to be made thinner, such as by reducing the width W to 3 mm or less, it is difficult to keep its factor Q from falling below 250.

Figure 3:
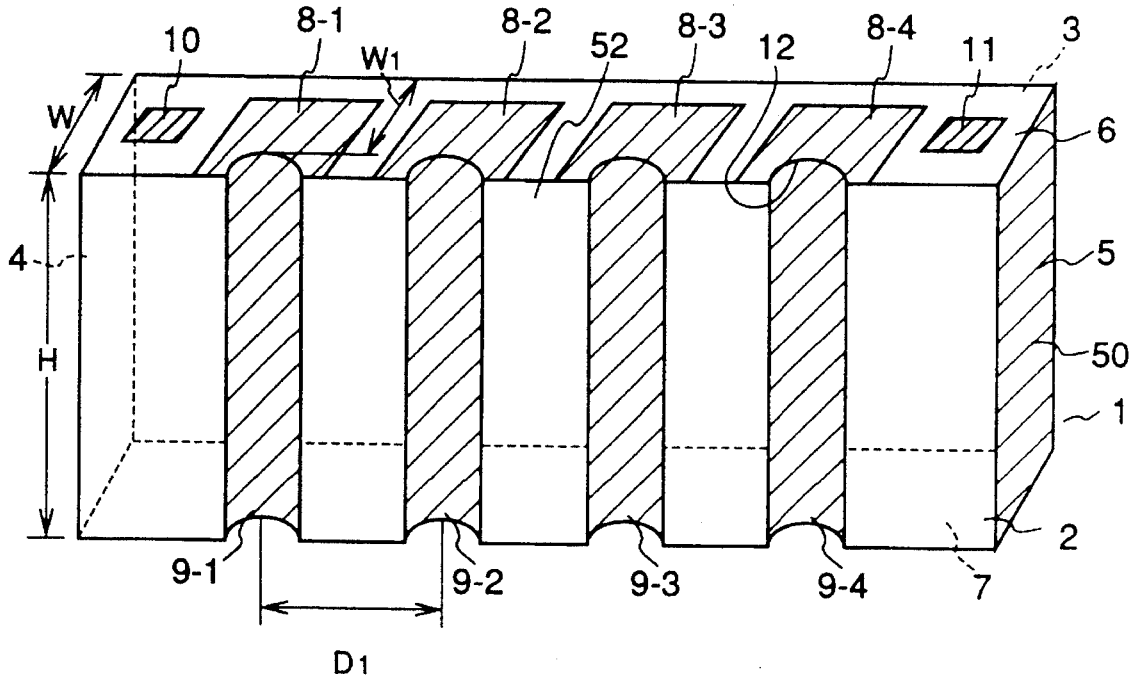
FIG. 3 is a perspective view of a strip line filter according to a preferred embodiment of the invention.

A strip line filter according to the invention, having characteristics similar to those of the dielectric filter shown in FIG. 1, but whose width W is reduced by substantially one half, is shown in FIG. 3.

In FIG. 3, a unitary, rectangular box-shaped dielectric block 1, has a height H shorter than a quarter or a half of the wavelength corresponding to the resonance frequency. Four of the six faces of the dielectric block 1, namely the back face 3, left and right side faces 4, 5, and bottom face 7, are covered by a thin layer of conductive material forming an outer conductor 50.

On a front face 2 of the dielectric block 1, four elongated conductive layers 9-1 to 9-4 are disposed in parallel, with distances D1 between their center lines so that the conductive layers are separated by exposed surfaces 52 of the dielectric block 1. These conductive layers 9-1 to 9-4 constitute resonators of the strip line filter. The resonators 9-1 to 9-4 are formed on four grooves, for example arc-shaped grooves 12, extending from a top face 6 to the bottom face 7, in the front face 2. The lower ends of the resonators 9-1 to 9-4 are short-circuited to the outer conductor 50 at the bottom face 7.

On the top face 6 of the dielectric block 1, thin film layers of conductive material form four resonance frequency adjusting electrodes 8-1 to 8-4, an input electrode 10, and an output electrode 11. The electrodes 8-1 to 8-4 are short-circuited to the upper ends of the resonators 9-1 to 9-4, and are disposed adjacent to the outer conductor 50, at the back face 3. These electrodes produce a reactance whose capacitance component is substantially effected by the gap between the back edges of the electrodes and the back face 3. The input electrode 10 is capacitively coupled to the electrode 8-1 to provide a capacitance component through which incoming signals are input to the strip line filter. The output electrode 11 is capacitively coupled with the electrode 8-4 to provide a capacitance component through which outgoing signals are output from the strip line filter.

The resonators 9-1 to 9-4 of this embodiment have an intermediate structure formed by combining features of (1) dielectric resonators having short-circuited ends and a height less than a quarter of the wavelength corresponding to the resonance frequency, for instance, of the dielectric resonators shown in FIG. 1, and (2) conventional strip line resonators described, for example, in the laid open Japanese utility model registration application No. 56-95102 having short-circuited ends and a height, equal to a quarter of the wavelength. The resonance frequencies of the resonators 9-1 to 9-4 are determined primarily by the height H of the dielectric block 1, and are adjusted by the resonance frequency adjusting electrode 8-1 to 8-4. The Q of the resonators 9-1 to 9-4 is determined mainly by the distance W1 from the base of each groove 12 to the back face 3. The degree of coupling between the resonators 9-1 to 9-4 is determined mainly by the lengths of the intervals D1 between the resonators 9-1 to 9-4.

Figure 4:
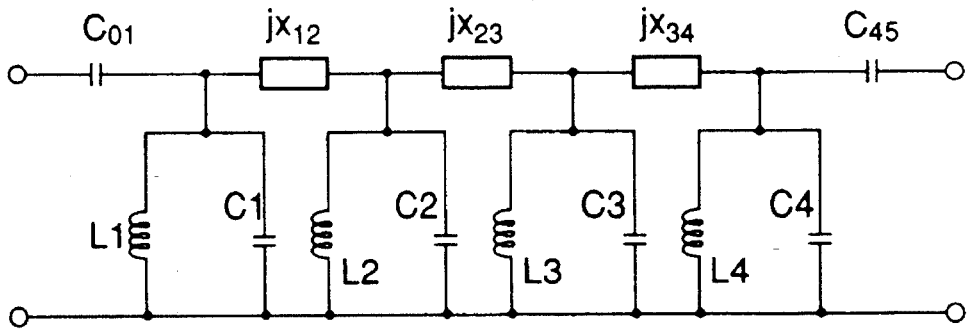
FIG. 4 is a diagram of the equivalent circuit for the strip line filter of FIG. 3.

FIG. 4 shows an equivalent circuit for the strip line filter of FIG. 3, wherein the distributed inductance and capacitance are represented by lumped constants. In FIG. 4, inductances L1 to L4 are equivalent inductances for the respective resonators 9-1 to 9-4 combined with the corresponding resonance frequency adjusting electrodes 8-1 to 8-4, and capacitances C1 to C4 are similarly equivalent capacitances for the respective resonators 9-1 to 9-4 combined with the corresponding electrodes 8-1 to 8-4. Each pair of an inductance and a capacitance forms a parallel resonant circuit. A capacitor C01 represents the capacitive coupling between the input electrode 10 and the resonance frequency adjusting electrode 8-1, and a capacitor C45 represents the capacitive coupling between the output electrode 11 and the resonance frequency adjusting electrode 8-4. Reactance elements jx12, jx23, and jx34 correspond to reactances between adjacent pairs of the resonators 9-1 to 9-4.

The equivalent circuit shown in FIG. 4 is almost the same as the equivalent circuit shown in FIG. 2. Therefore, the strip line filter shown in FIG. 3 operates in substantially the same manner as the dielectric filter shown in FIG. 1.

Figure 5:
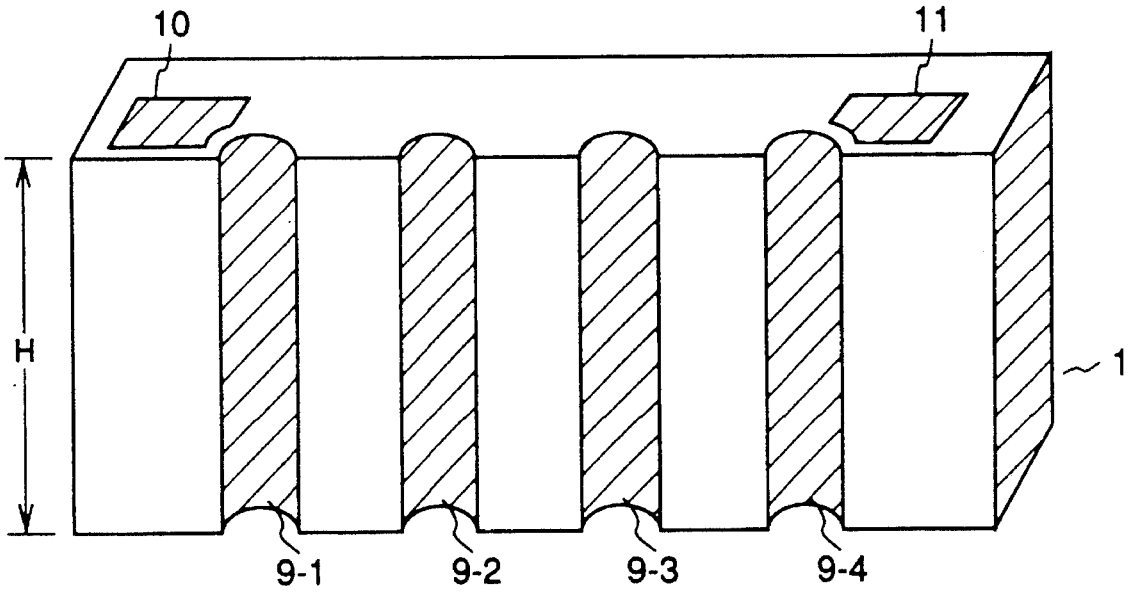
FIG. 5 is a perspective view of a strip line filter according to another preferred embodiment of the invention.

FIG. 5 is a perspective view of another embodiment of the invention. In FIG. 5, the same reference numerals as those in FIG. 3 designate the same or corresponding elements. The structure of the strip line filter of FIG. 5 differs from the strip line filter shown in FIG. 3 primarily in that resonance frequency adjusting electrodes are not provided. The input electrode 10 is disposed on the top face to provide a direct capacitive coupling with a top end of the resonator 9-1. The output electrode 11 is disposed at the top face to provide a direct capacitive coupling with the top end of the resonator 9-4. The equivalent circuit for this embodiment, like that of FIG. 3, is represented by the circuit shown in FIG. 4.

It is to be noted that since the strip line filter of FIG. 5 does not have resonance frequency adjusting electrodes, the height H of the dielectric block 1 is set to about a quarter or half of the wavelength corresponding to the resonance frequency, so that the filter resonates at a predetermined frequency only in the resonators 9-1 to 9-4.

In order to input signals to and output signals from the strip line filters shown in FIGS. 3 and 5, for example, input and output capacitors may be provided externally of the filter, and these capacitors may be connected with the resonators. An effect similar to that of a strip line resonator having short-circuited ends and a height of a quarter of the wavelength, can be obtained in the case of a filter having a height which is less than or equal to one half of the wavelength.

As described above, the strip line filters shown in FIGS. 3 and 5 may have a width W, which is half that of the conventional dielectric filter shown in FIG. 1, and the Q may have a value which meets usual demands (Q≧250). Tests performed by the inventor have demonstrated this to be the case, as will be explained below.

Figure 6A:
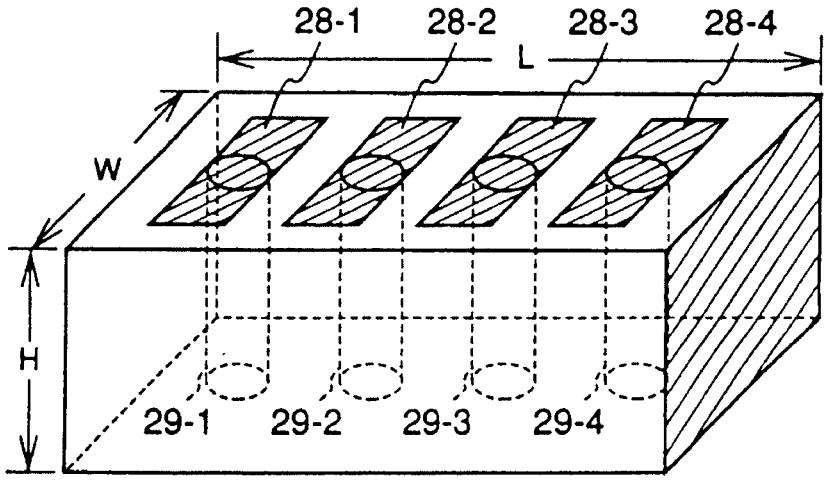
FIG.6A PRIOR ART
FIGS. 6A and 6B are perspective views respectively of a dielectric filter of the prior art, upon which comparative tests were performed, and the strip line filter according to the invention.

The quality factor Q was measured for the conventional dielectric filter illustrated in FIG. 6A, which is includes a unitary, rectangular box-shaped dielectric block having a width W of 4.0 mm, a length L of 15.8 mm, and a height H of 7.8 mm. This filter is of a design similar to that illustrated in the above-described FIG. 1. Measurements were taken also for a dielectric filter having the same size as the filter shown in FIG. 6A, but not having resonance frequency adjusting electrodes. The measurement results are summarized in part A of Table 1 below.

Figure 6B:
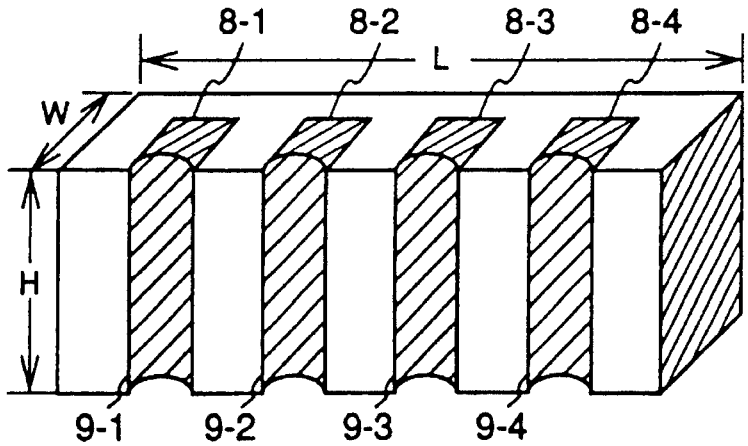

FIG. 6B shows a strip line filter of a design similar to that illustrated in FIG. 3, wherein the dielectric block 1 has a width W of 2.0 mm, a length L of 15.8 mm, and a height H of 8.35 min. This structure is substantially obtained by dividing the dielectric filter shown in FIG. 6A in half along the center of the dielectric resonators. (The difference in the height H of the two filters is considered to be insignificant.). Measurements were likewise taken for a strip line filter having the same size as the filter shown in FIG. 6B, but not having the resonance frequency adjusting electrodes. Thus, the latter filter has a design similar to that shown in FIG. 5. These measurements are summarized in Part B of Table 1.

TABLE 1

(A) Dielectric Filter

| | | Resonator No. | | | |
|---|---|---|---|---|---|
| | | Resonator 29-1 | Resonator 29-2 | Resonator 29-3 | Resonator 29-4 |
| With Resonance Frequency Adjusting Electrodes | Resonant Frequency (MHz) | 913.1 | 898.8 | 901.9 | 720.8 |
| | Q | 366 | 371 | 382 | 350 |
| Without Resonance Frequency Adjusting Electrode | Resonant Frequency (MHz) | 1036.0 | 1027.0 | 1025.0 | 1032.0 |
| | Q | 394 | 434 | 438 | 393 |

(B) Strip Line Filter

| | | Resonator 9-1 | Resonator 9-2 | Resonator 9-3 | Resonator 9-4 |
|---|---|---|---|---|---|
| With Resonance Frequency Adjusting Electrodes | Resonant Frequency (MHz) | 1010.9 | 946.4 | 959.0 | 994.8 |
| | Q | 272 | 313 | 284 | 270 |
| Without Resonance Frequency Adjusting Electrodes | Resonant Frequency (MHz) | 1135.4 | 1114.1 | 1103.4 | 1118.8 |
| | Q | 292 | 323 | 321 | 280 |

Part A of Table 1 shows measured values of the resonance frequency and Q for the four resonators in the conventional dielectric filter shown in FIG. 6A, and the results of such measurements for the conventional dielectric filter formed without resonance frequency adjusting electrodes. According to these results, the conventional dielectric filters had a Q of 350 or above in a band of 900 MHz.

On the other hand, Part B of Table 1 shows measured values of the resonance frequency and Q for the four resonators of the strip line filter shown in FIG. 6B, and for the resonators of the strip line filter formed without resonance frequency adjusting electrodes. According to these results, the strip line filter without resonance frequency adjusting electrodes had a Q of 280 or above in the band of 900 MHz, and with resonance frequency adjusting electrodes, a Q of 270 or above in the band of 900 MHz.

Thus, the measurements demonstrate that strip line filters of the designs shown in FIGS. 3 and 5 can have a width half that of the conventional dielectric filter, and yet retain a Q of 250 or above. In Table 1, in the case where the filters are formed with resonance frequency adjusting electrodes, the resonance frequency is lowered only by the reactance of the resonance frequency adjusting electrodes, and the Q is lowered only by the loss due to these electrodes.

Figure 7A:
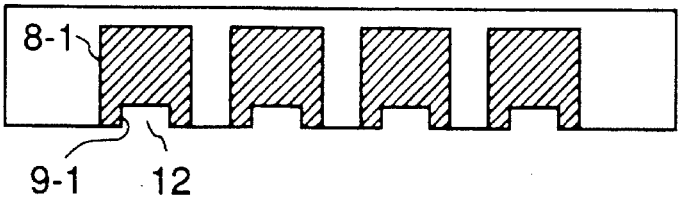
FIGS. 7A and 7B are top views showing alternative patterns of grooves of the strip line filter.
Figure 7B:
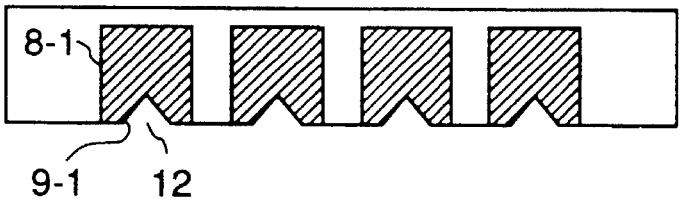

FIGS. 7A and 7B illustrate variations on the shape of the resonator grooves 12, which may be used in any of the embodiments illustrated or described herein. FIG. 7A is a top view of an embodiment in which the grooves 12 have rectangular cross section, and FIG. 7B illustrates a V-shaped groove. However, the grooves according to the invention are not restricted to these shapes and may be formed in various other shapes.

FIGS. 8A to 11C show various arrangements for adjusting the degree of coupling between the resonators. In these figures, the same reference numerals as those in FIG. 3 designate the same or corresponding elements.

Figure 8A:
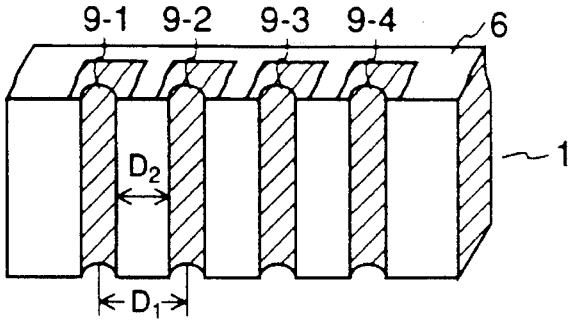
FIGS. 8A to 8E are perspective views of strip line filters with different reactive coupling between the resonators.

FIG. 8A shows a strip line filter which is similar to that shown in FIG. 3, except that the input electrodes and the output electrodes are omitted. Although, as described above, the degree of coupling between the resonators is determined mainly by the distance D1 between the center lines of the resonators 9-1 to 9-4, the degree of coupling can be adjusted by changing the distance D2 between the adjacent resonator side edges.

Figure 8B:
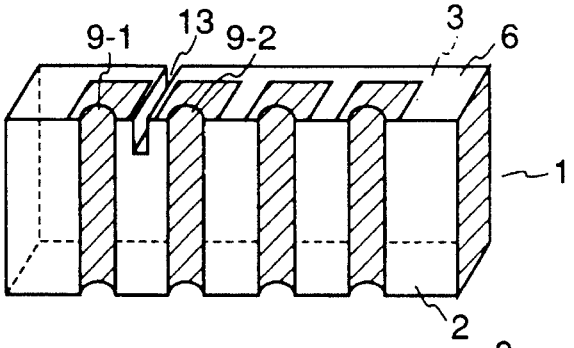

FIG. 8B shows a strip line filter having a groove 13 of predetermined depth, in the top face 6 of the dielectric block 1, extending from the front face 2 to the back face 3, between the resonators 9-1 and 9-2. This groove 13 produces an inductive coupling between the resonators, so that the degree of coupling can be adjusted by changing the inductance. The inductance may be varied by changing the depth and/or the width of the groove 13.

Figure 8C:
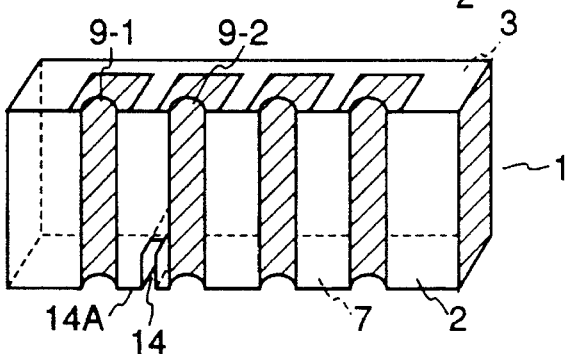

FIG. 8C shows a strip line filter having a groove 14 of predetermined depth, in the bottom face 7, extending from the front face 2 to the back face 3, between the resonators 9-1 and 9-2. The surface of the groove 14 is covered with a thin film conductor 14A, which is connected to the outer conductor 50 at the bottom face 7. This groove 14 forms a capacitor which provides capacitive coupling between the resonators 9-1 and 9-2, so that the degree of coupling can be adjusted by changing the capacitance. The capacitance may be varied by changing the depth and/or the width of the groove 14.

Figure 8D:
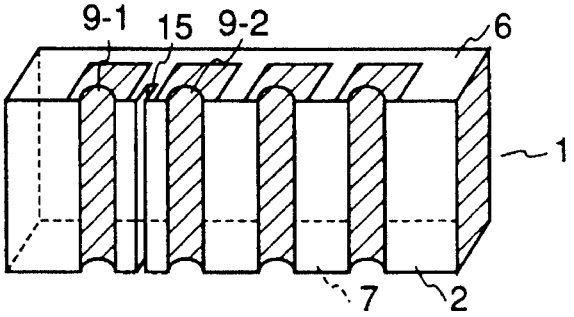

FIG. 8D shows a strip line filter having a groove 15 of predetermined depth, in the front face 2, extending from the top face 6 to the bottom face 7 between, and parallel to the resonators 9-1 and 9-2. This groove 15 provides inductive coupling between the resonators, so that the degree of coupling can be adjusted by changing the inductance. The inductance may be varied by changing the depth and/or the width of the groove 15.

Figure 8E:
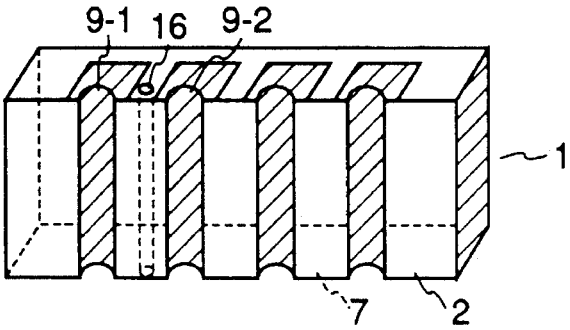

FIG. 8E shows a strip line filter having a small hole 16 adjacent the front face 2, extending from the top face 6 to the bottom face 7, between and parallel to the resonators 9-1 and 9-2. This hole 16 provides an inductive coupling between the resonators, so that the degree of coupling can be adjusted by changing the inductance. The inductance may be varied by changing the diameter of the hole 16.

It will be appreciated by persons skilled in the art, that the above-described means for coupling the resonators can be applied to a filter formed without the resonance frequency adjusting electrodes, such as the filter shown in FIG. 5.

The strip line filter provided with resonance frequency adjusting electrodes on the top face is capable of adjustment with respect to the degree of capacitive coupling among the resonators, by adjusting the resonance frequency adjusting electrodes and ether electrodes on the top face 6. Thus, for example, in FIG. 9A, the degree of capacitive coupling between adjacent pairs of resonators may be adjusted by changing the distance between the corresponding pairs of resonance frequency adjusting electrodes. Therefore, the distance D3 between electrodes 8-1 and 8-2 is set or adjusted to determine or change the degree of capacitive coupling between the electrodes 8-1 and 8-2 and thus between the resonators 9-1 and 9-2.

Figure 9A:
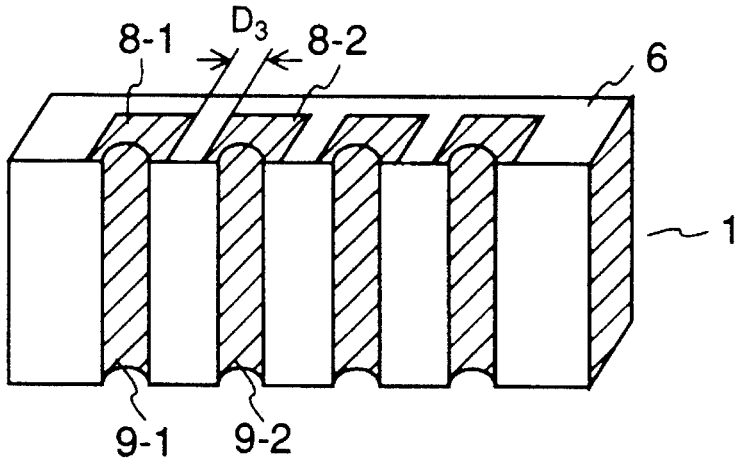
FIGS. 9A to 9C are perspective views of strip line filters according to the invention, having different reactive coupling between the resonance frequency adjusting electrodes.
Figure 9B:
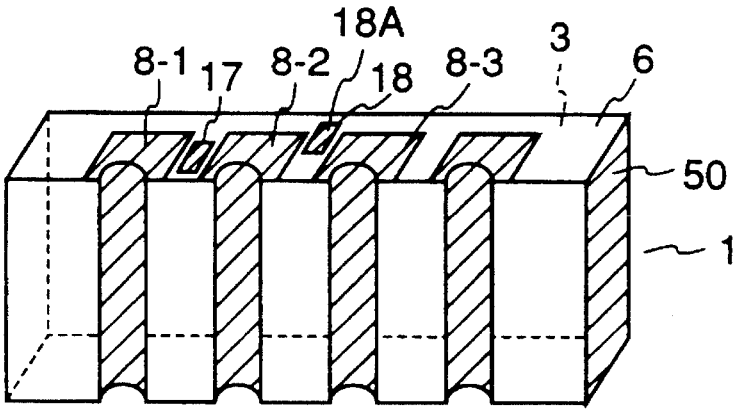

FIG. 9B shows a strip line filter having a small reactance coupling electrode 17 formed on the top face 6 between the electrodes 8-1, 8-2. The electrode 17 adds capacitive reactance coupling between the electrodes 8-1, 8-2, so that the degree of coupling can be adjusted by changing the capacitance. The capacitance provided by the electrode 17 may be varied by changing the distances between the electrode 17 and the electrodes 8-1, 8-2.

Another small electrode 18 on the top face 6 is located between the electrodes 8-2 and 8-3, with one end 18A of the electrode 18 adjacent to the outer conductor 50, at the back face 3. The electrode 18 and outer conductor 50 provide a capacitance, so that the degree of coupling between the resonators can be adjusted by changing this capacitance. The capacitance provided by the electrode 18 may be varied by changing the distance between the electrode 18 and the outer conductor 50. As the distance between the electrode 18 and the outer conductor 50 becomes greater, the capacitance becomes smaller, and the degree of coupling between the resonators in mm becomes greater with such reduced capacitance.

Figure 9C:
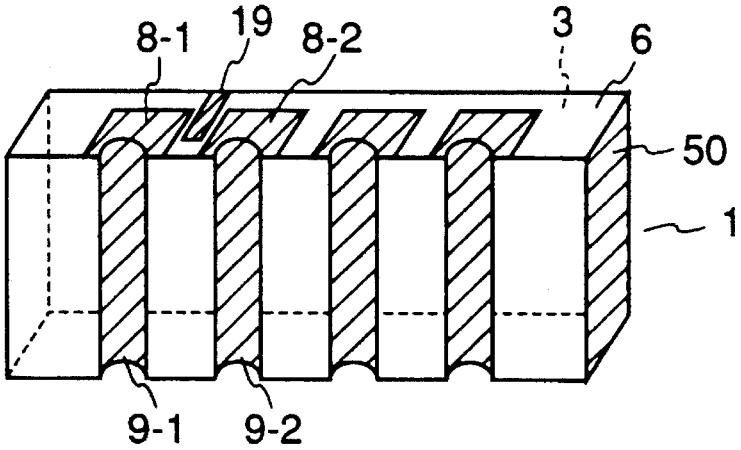

FIG. 9C shows a strip line filter having a strip electrode 19 located on the top face 6 between the electrodes 8-1, 8-2, with one end of the electrode connected to the outer conductor 50 at the back face 3. The electrode 19 provides an inductive coupling between the resonators 9-1 and 9-2, so that the degree of coupling can be adjusted by changing the inductance. The inductance may be varied by changing the length and/or the width of the electrode 19.

FIGS. 10A to 10C show respective top, front and side views of an embodiment in which capacitive electrodes are used to change the degree of coupling between the resonators. These electrodes are formed on opposite sides of a substrate 20 that is disposed in opposing parallel relation to the front face 2 of the dielectric block 1. The substrate 20 is fixed over the front face 2 of the dielectric block 1. Alternatively, the substrate can be disposed over the top face 6 or the bottom face 7. Electrodes 22-1 to 22-5 are arranged on a front face 20A of the substrate 20 so as to be approximately in a row. Electrodes 21-1 to 21-5 are disposed on a back face 20B of the substrate 20, opposite the electrodes 22-1 to 22-5. The five opposed electrode pairs form respective coupling capacitors C 1 to C5. The coupling capacitors C2, C3, and C4 are electrically connected so as to be respectively inserted between the resonators 9-1, 9-2, between the resonators 9-2, 9-3, and between the resonators 9-3, 9-4. Therefore, the degree of coupling between the resonators can be adjusted by changing the capacitances of the capacitors C2 to C4. The capacitances may be varied by changing the areas of the opposing surfaces of the electrodes 21-2 to 21-4 and 22-2 to 22-4. The capacitors C1 and C5 serve as coupling capacitors for inputting and outputting signals to and from the filter.

Figure 11A:
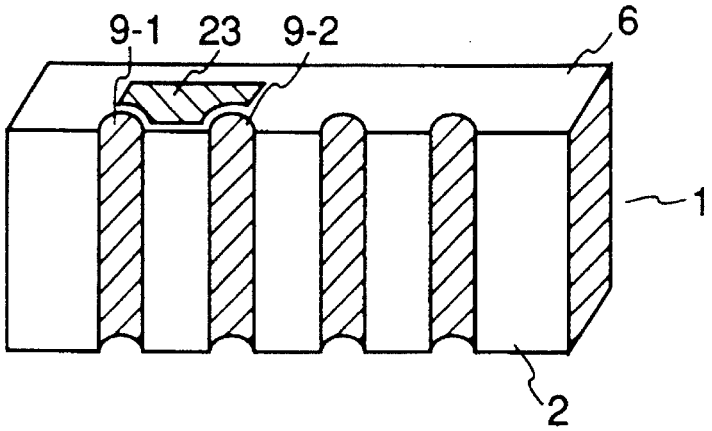
FIGS. 11A and 11B are perspective views of further strip line filters according to the invention, provided with capacitive coupling between the resonators.
Figure 11B:
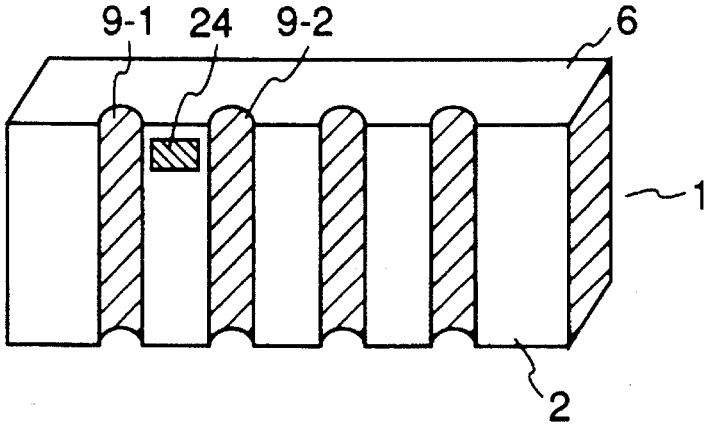

FIG. 11A shows a strip line filter having an electrode 23 on the top face 6 of the dielectric block 1, near the top ends of the resonators 9-1 and 9-2. The electrode 23 capacitively couples the top ends of the resonators 9-1 and 9-2. FIG. 11B shows a strip line filter having an electrode 24 near the top of the front face 2, between the resonators 9-1, 9-2, which capacitive couples these resonators. The electrodes 23 and 24 of FIGS. 11A and 11B, function similarly to the electrode 17 shown in FIG. 9B, to perform an adjustment of the degree of coupling between the resonators.

Figure 11C:
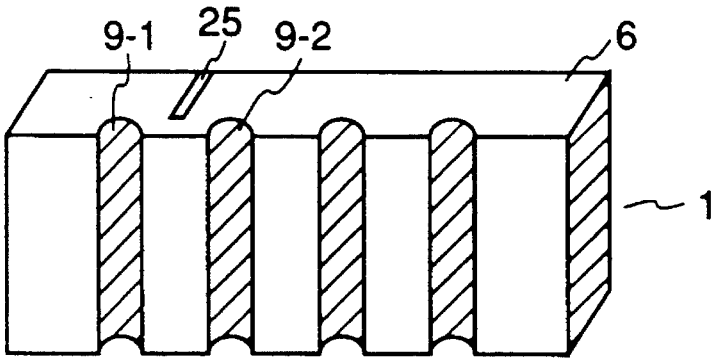
FIG. 11C is a perspective view of another strip line filter according to the invention, having an inductive coupling between the resonators.

FIG. 11C shows a strip line filter having an electrode 25 on the top face of the dielectric block 1, which inductively couples the resonators 9-1 and 9-2. The electrode 25 functions similarly to the electrode 19 shown in FIG. 9C.

It is to be noted that although FIGS. 8A to 8E, 9A to 9C, and 11A to 11C show arrangements provided mainly for adjusting the degree of coupling between the resonator 9-1 and the resonator 9-2, such arrangements can be applied to the couplings between the other adjacent pairs of resonators.

Figure 12A:
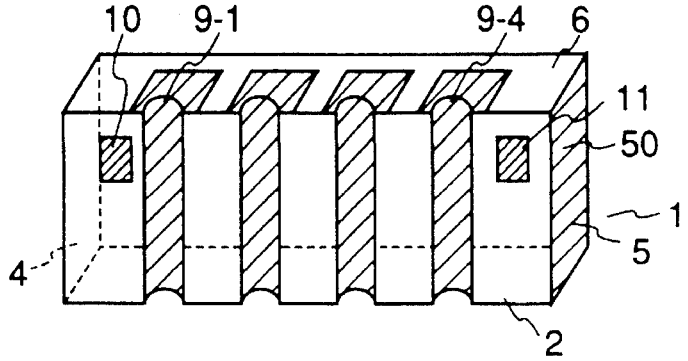
FIGS. 12A to 12D are perspective views of further strip line filters according to the invention, having different arrangements of input and output electrodes.

FIGS. 12A to 12D illustrate several alternative arrangements of the input and output (reactance coupling) electrodes 10 and 11 on the dielectric block 1. In these figures, the same reference numerals as those in FIGS. 3 and 10A to 10C designate the same or corresponding elements. FIG. 12A shows a strip line filter having the input electrode 10 and output electrode 11 formed on the front face 2. The electrodes are located on the sides of the respective resonators 9-1 and 9-4, adjacent to the side faces 4 and 5, so as to provide a capacitive reactance coupling with the respective resonators.

Figure 12B:
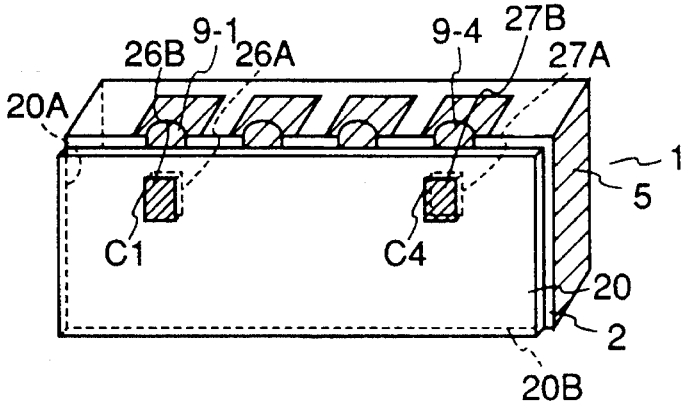

FIG. 12B shows a strip line filter, which, like the embodiment of FIGS. 10A to 10C, has a substrate 20 opposing the front face 2 of the dielectric block 1, in parallel relation thereto. Electrodes 26A, 27A on the back face 20A of the substrate 20, and electrodes 26B, 27B located on the front face 20B of the substrate, form respective capacitors C1 and C4 that oppose the respective resonators 9-1 and 9-4. The electrodes 26B, 27B may be connected to an external circuit for inputting and outputting signals. In a further alternative arrangement, the substrate 20 can be disposed in parallel opposing relation to the top face or the bottom face.

Figure 12C:
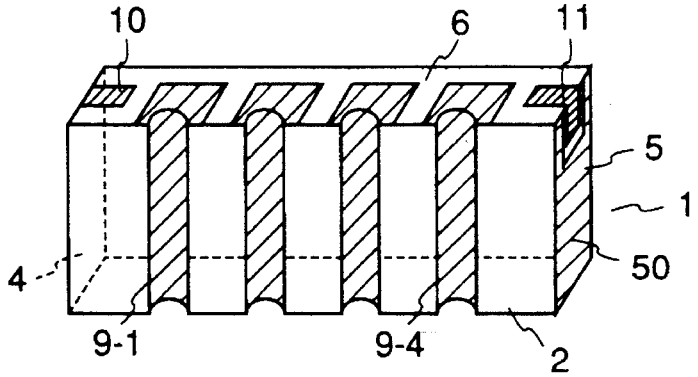
Figure 12D:
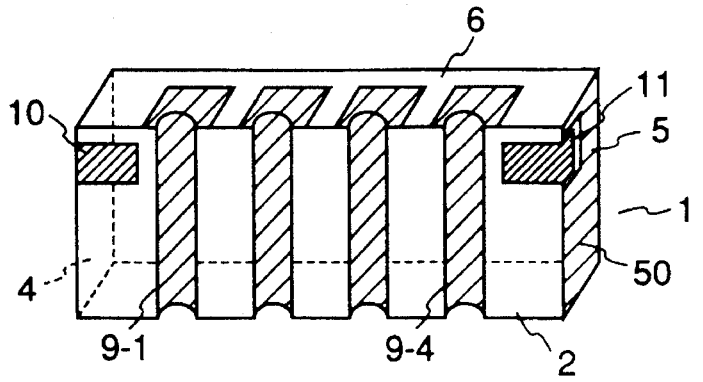

FIGS. 12C and 12D show arrangements wherein the input electrode 10 and the output electrode 11 extend onto respective portions of side faces 4 and 5 not covered by the conductive layer 50. In FIG. 12C, the input electrode 10 is provided on adjacent portions of the top face 6 and left side face 4, and the output electrode 11 is provided on adjacent portions of the top face and the right face 5. In FIG. 12D, the input electrode 10 is provided on adjacent, otherwise exposed, portions of the front face 2 and left side face 4, and the output electrode 11 is provided on adjacent, otherwise exposed, portions of the front face and the right face 5. These electrodes facilitate connection to an external circuit, from the side face.

Figure 13B:
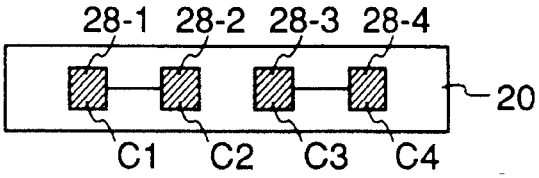
FIGS. 13A to 13C are respective top, front and side views of yet another strip line filter according to the invention, with a separate substrate bearing input, output and over-coupling capacitors connected to the resonators.
Figure 13A:
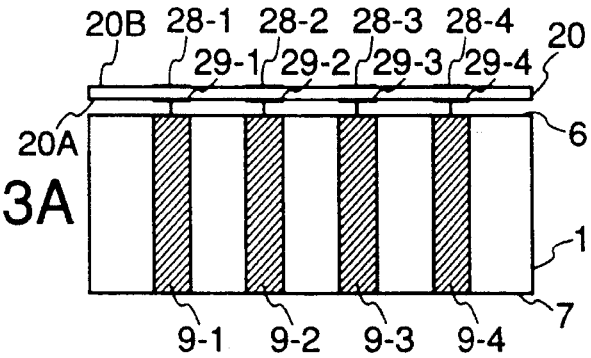
Figure 13C:
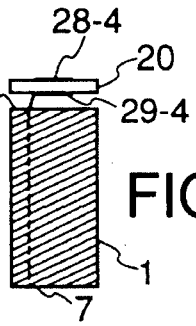

The strip line filter according to FIG. 3 is readily modified to form a filter with attenuation poles at finite frequencies (hereinafter referred to as "polar filter"). FIGS. 13A to 13C, respectively, are front, plan and right side views of a polar strip line filter according to yet another embodiment of the invention. In these figures, the same reference numerals as those in FIGS. 3 and 10A to 10C designate the same or corresponding elements. This embodiment includes resonance frequency adjusting electrodes, like the electrodes 8-1 to 8-4 shown in FIG. 3, and input and output electrodes, like the electrodes 10 and 11 shown in FIG. 3. However, for ease of illustration of other features, they have been omitted from FIGS. 13A to 13C. A substrate 20, suitable for high frequency applications, is fixed to the top face 6 of the dielectric block 1 in a predetermined spaced parallel relation thereto. The substrate alternatively can be fixed to the bottom face 7. Electrodes 28-1 to 28-4 and 29-1 to 29-4 are provided on the respective front face 20A and back face 20B of the substrate, so as to form respective capacitors C01, Cp1, Cp2 and C02. The back face electrodes 29-1 to 29-4, opposing the top face 2 of the dielectric block, are connected to the respective resonators 9-1 to 9-4. The electrode 28-1 is connected to the electrode 28-2, and the electrode 28-4 is connected to the electrode 28-3. The electrodes 28-1, 28-4 also am to be connected to an external circuit.

Figure 14:
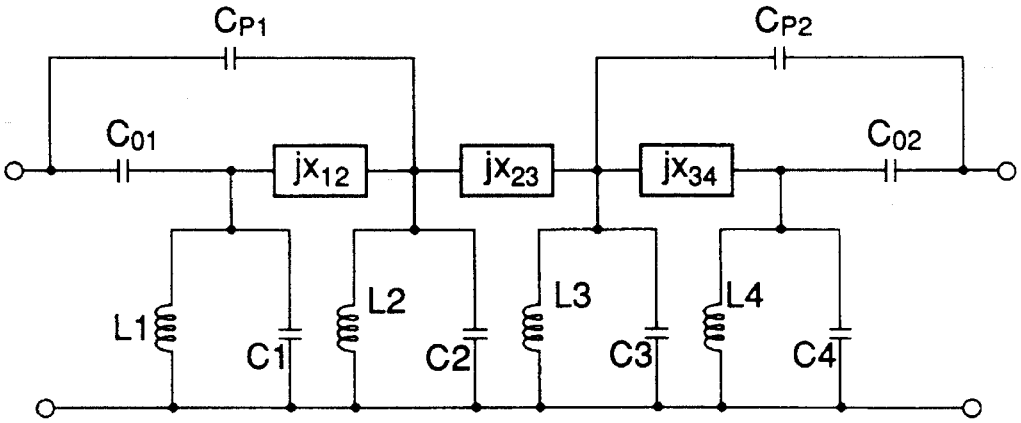
FIG. 14 is a diagram illustrating an equivalent circuit of the strip line filter of FIGS. 13A to 13C.

FIG. 14 illustrates an equivalent circuit for the strip line filter of FIGS. 13A to 13C, wherein the distributed inductance and capacitance are represented by lumped constants. As will be apparent to those skilled in the art, this strip line filter constitutes a polar filter. In FIG. 14, inductances L1 to L4 are equivalent inductances of the respective resonators, and capacitances C1 to C4 are equivalent capacitances thereof. Each parallel inductance and capacitance constitutes a parallel resonant circuit. Reference numerals jx12, jx23, and jx34 designate reactances between the resonators. The capacitors Cp1 and Cp2 serve as over-coupling capacitors for producing attenuation poles at finite frequencies. Thus, the polar filter is readily formed by adding, to the strip line filter shown in FIG. 3, a substrate formed with over-coupling capacitors.

FIG. 15A, 15B and 15C respectively are front, top and right side views of a strip line filter according to a further embodiment of the invention. In these figures, the same reference numerals as those in FIGS. 13A to 13C designate the same or corresponding elements. This filter is the same as the strip line filter shown in FIGS. 13A to 13C, except that the substrate 20, with over-coupling capacitors for producing attenuation poles, is provided at the front face 2 of the dielectric block, rather than at the top face 6. The equivalent circuit of FIG. 14 also represents the filter of FIGS. 15A to 15C.

It is to be noted that although the resonance frequency adjusting electrodes are formed on the top face 6 of the dielectric block 1 in the two filters shown in FIGS. 13A to 13C and 15A to 15C (although not illustrated in FIGS. 13A to 13C), such polar filters according to the invention can be constructed without the resonance frequency adjusting electrodes.

The strip line filters of the invention readily can be used to form a duplexer filter which is thinner than those of the prior art. FIG. 16 is a block diagram of a duplexer filter. The duplexer filter includes a separating circuit 30 connected to a transmitting filter 31 and to a receiving filter 32. The separating circuit 30 serves to assure that the transmitting filter 31 and the receiving filter 32 do not interfere with each other. That is, the circuit 30 serves to prevent crosstalk between the two filters when a signal from a transmitter has passed through the transmitting filter 31 on its way to being transmitted via to an antenna, or when a signal on the antenna is to pass through the receiving filter on its way to a receiver.

Figure 17B:
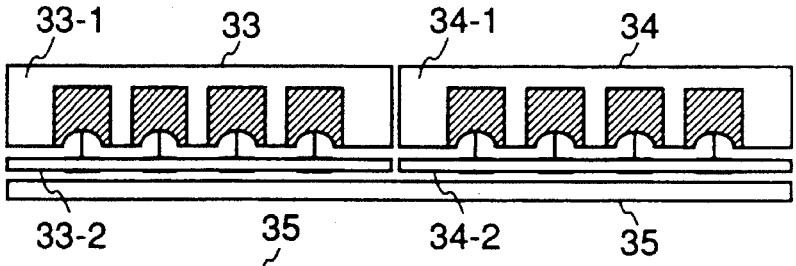
FIGS. 17A to 17C are respective top, front and side views of a duplexer filter according to a preferred embodiment of the invention.
Figure 17A:
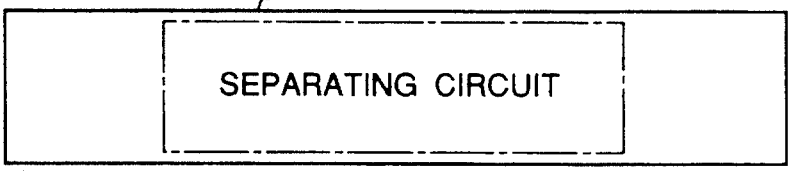
Figure 17C:
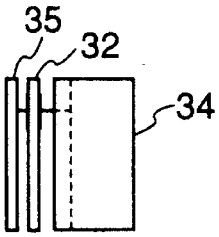

FIGS. 17A, 17B and 17C are respective front, top and right side views of a duplexer filter according to the invention. The duplexer filter according to the invention includes a distributed constant line, such as a strip line 35, for the separating circuit. The duplexer also includes strip line filters 33 and 34, respectively as the transmitting filter and the receiving filter. The separating circuit and the filters are connected in the same manner as in the block diagram of FIG. 16.

The transmitting filter 33 and the receiving filter 34 each may have, for example, a structure like that of the polar filter of FIGS. 15A to 15C. Thus, the transmitting filter 33 may include a dielectric block 33-1, on which are provided resonators and resonance frequency adjusting electrodes, like those illustrated in FIGS. 15A to 15C. The filters 33 and 34 may also have, for example, a structure like that of the non-polar type filter of FIGS. 3 and 5. Opposing the front face of the dielectric block 33-1 is a substrate 33-2 on which capacitive pairs of electrodes are arranged as in FIGS. 15A to 15C. Similarly, the receiving filter 34 may include a dielectric block 34-1 on which resonators and resonance frequency adjusting electrodes likewise are provided. Opposing the front face of the dielectric block 34-1 is a substrate 34-2 on which capacitive pairs of electrodes are arranged as in FIGS. 15A to 15C.

It is to be noted that the detailed circuitry of the separating circuit 35 is known to those skilled in the art and is described, for example, in Japanese Published Patent Application No. 62-215047. A detailed description of the separating circuit 35 therefore is omitted.

Figure 18:
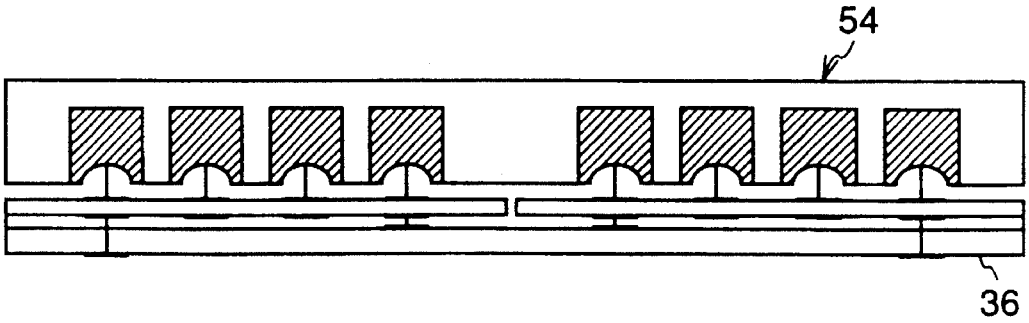
FIG. 18 is a top view of a duplexer filter according to another preferred embodiment of the invention.

FIG. 18 is a top view of such a duplexer filter according to another embodiment of the invention. The dielectric blocks 33-1 and 34-1 of the filters 33 and 34 are merged into a unitary dielectric block 54. The substrates 33-2 and 34-2, and the substrate of the separating circuit 35, are merged into a multilayer substrate 36.

The elements of the duplexer filter of FIGS. 17A to 17C may be consolidated to reduce the number of parts and thereby to reduce cost.

Figure 19:
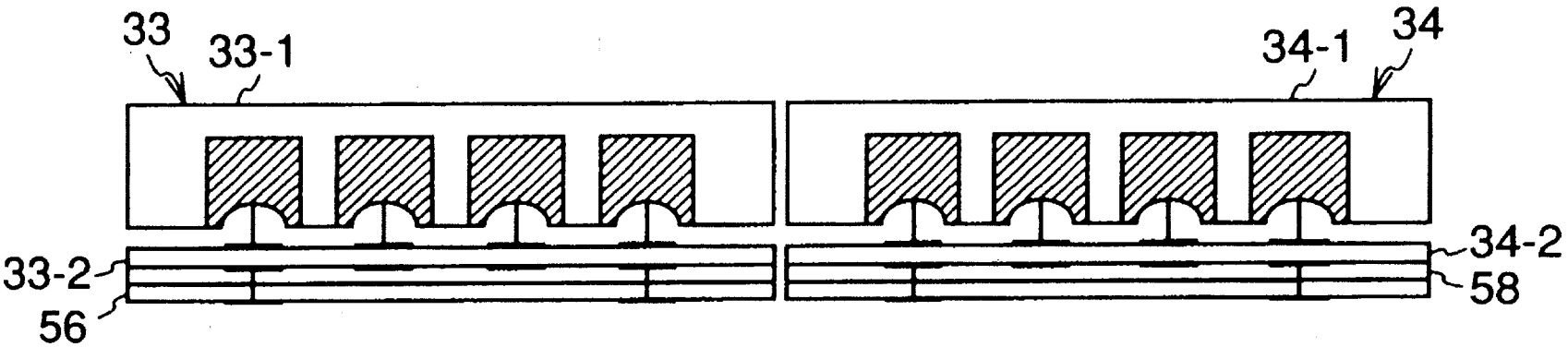
FIG. 19 is a top view of a duplexer filter according to a further preferred embodiment of the invention.

FIG. 19 is a top view of a duplexer filter according to yet another embodiment of the invention. In this duplexer, the substrate of the separating circuit 35 shown in FIGS. 17A to 17C, is divided into two parts. One part, and a substrate 33-2 of the transmitting filter 33, are combined in a multilayer substrate 56. The other part, and a substrate 34-2 of the receiving filter 34, are combined in another multilayer substrate 58.

It is to be noted that, although the substrates of FIGS. 17A to 17C, or the multilayer substrates of FIGS. 18 and 19, are disposed in parallel with the front face of the dielectric block, such substrates alternatively can be disposed in parallel with the top or bottom face of the dielectric block. Furthermore, in other embodiments, the substrate of the separating circuit 35 shown in FIGS. 17A to 17C, and the multilayer substrate shown in FIG. 18, can be formed in common with a substrate for the circuits of the transmitter and the receiver. Since the separating circuit 35 is also divided into two parts in this duplexer filter, lead lines can be used to connect the parts, or a new separating circuit can be formed on another substrate or the like.

Figure 20:
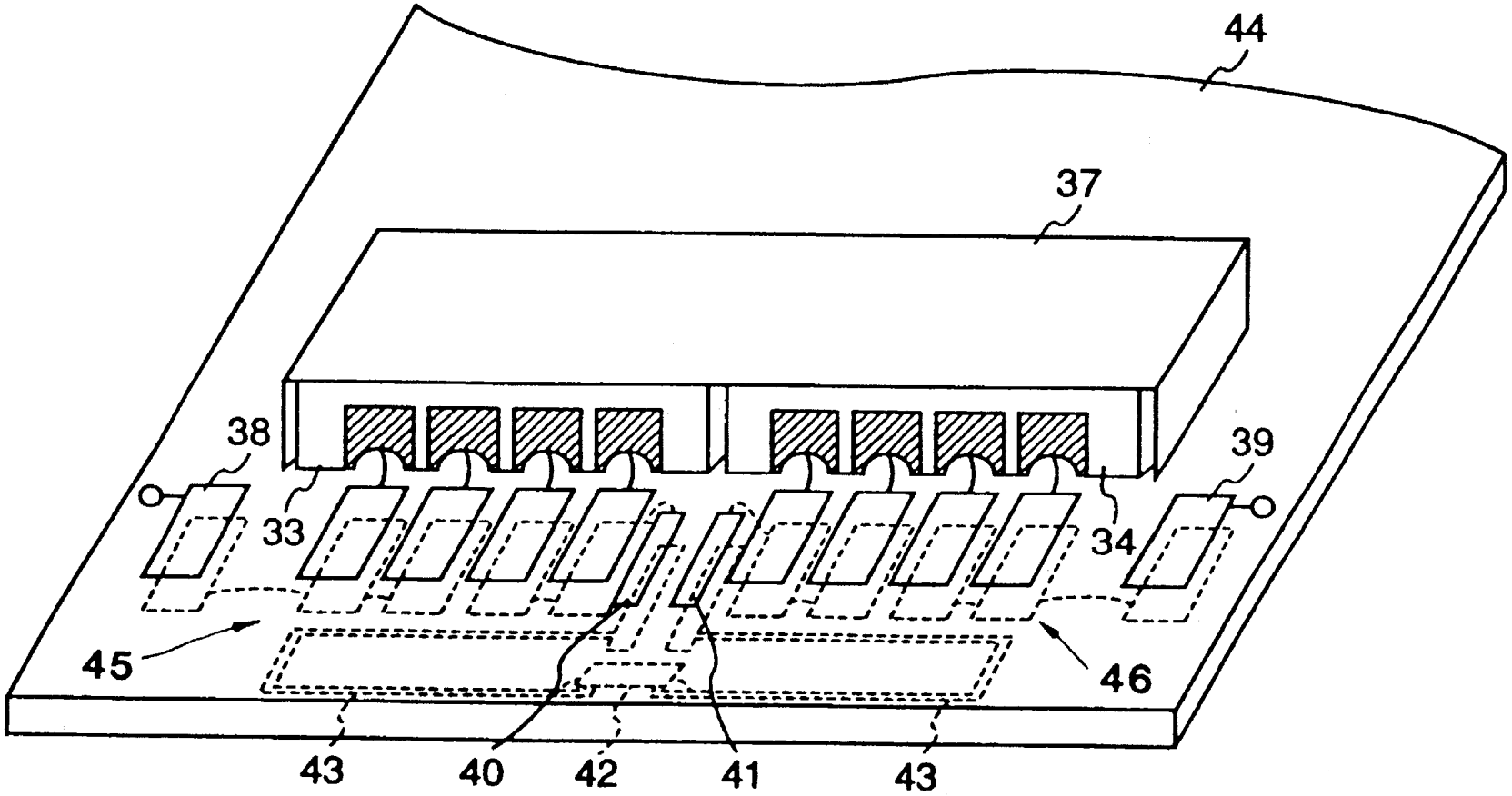
FIG. 20 is a perspective view of a duplexer filter according to still another preferred embodiment of the invention.
Figures 21A, 21B, 21C, 21D, 21E:
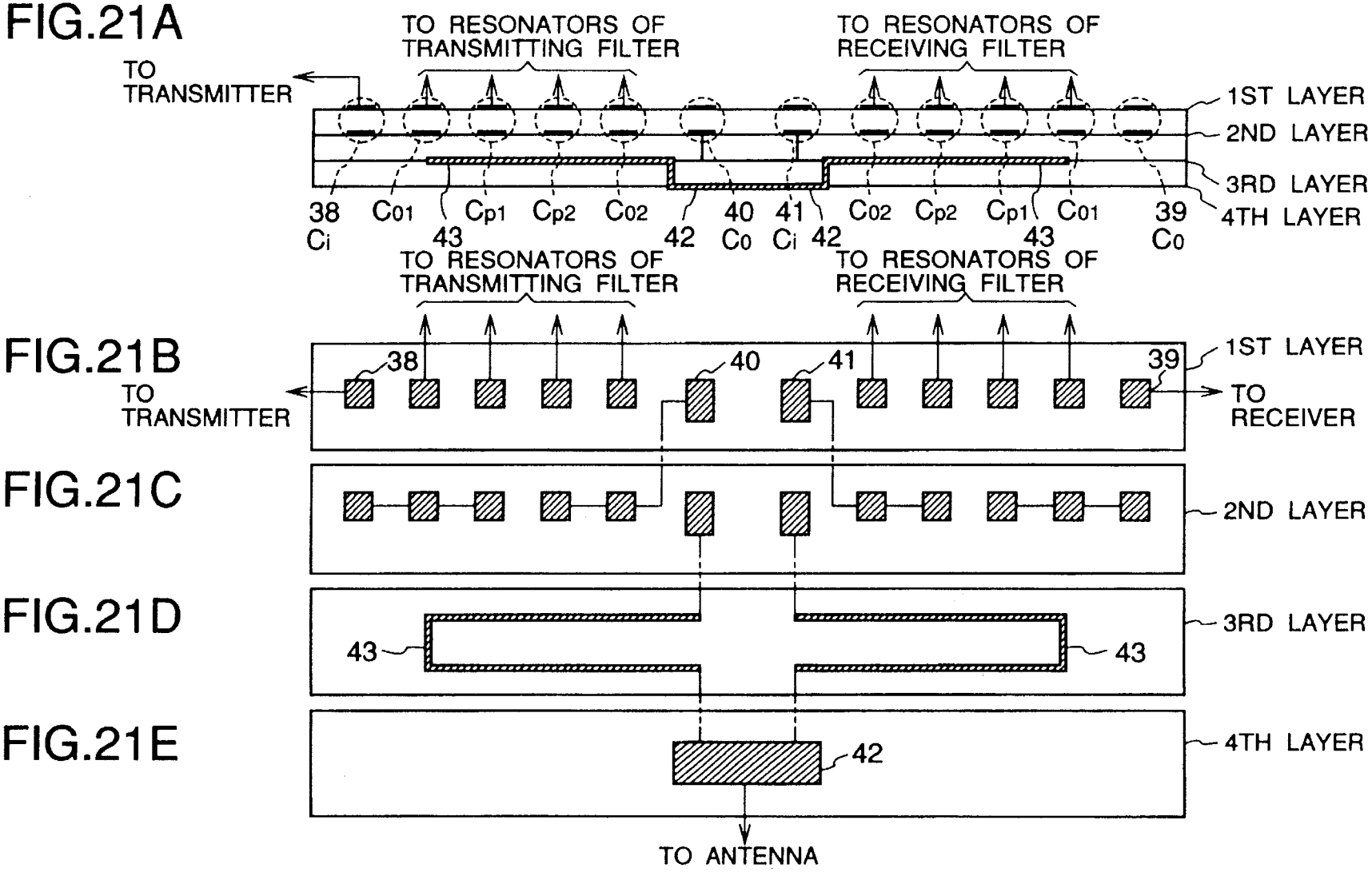
FIG. 21A to 21E are cross-sectional and respective top views illustrating layers of the multilayer substrate 4, shown in FIG. 20.

FIG. 20 is a schematic perspective view of a further duplexer according to the invention. In FIG. 20, the elements of the duplexer shown in FIGS. 17A to 17C are integrated with a multilayer substrate 44, common to the transmitter, the receiver, and the like. Sets 45 and 46 of over-coupling capacitors or capacitors for adjusting the resonance frequency and for coupling between the resonators and the like (not shown in detail in the figure), are formed on and between the first and second layers of the multilayer substrate 44. The sets 45 and 46 of capacitors are respectively connected to the transmitting filter 33 and the receiving filter 34. Also provided on and between these first and second layers are an input end capacitor 38 for the transmitting filter 33, an output end capacitor 39 for the receiving filter 34, an output end capacitor 40 for the transmitting filter 33, and an input end capacitor 41 for the receiving filter 34. The separating circuit 43 is formed on and between the third layer and the fourth layer. The transmitting filter 33 and the receiving filter 34, each composed of a strip line filter, are arranged parallel on the multilayer substrate 44, so that the resonators oppose the multilayer substrate 44 in parallel relation thereto. The resonators are connected to electrodes for the over-coupling capacitors and the like via metal connectors. The transmitting filter 33 and the receiving filter 34 are covered by a metal casing 37, provided for shielding. A coupling terminal 42 is adapted to connect to an antenna (not shown). In the duplexer filter thus constructed, the characteristics of the filters can be adjusted readily while the filters are in place on the substrate 44, by cutting away portions of the electrodes formed on the surface of the multilayer substrate, through trimming or the like.

FIG. 21A to 21E show cross-sectional and respective top views illustrating layers of the multilayer substrate 44 shown in FIG. 20.

Figure 22:
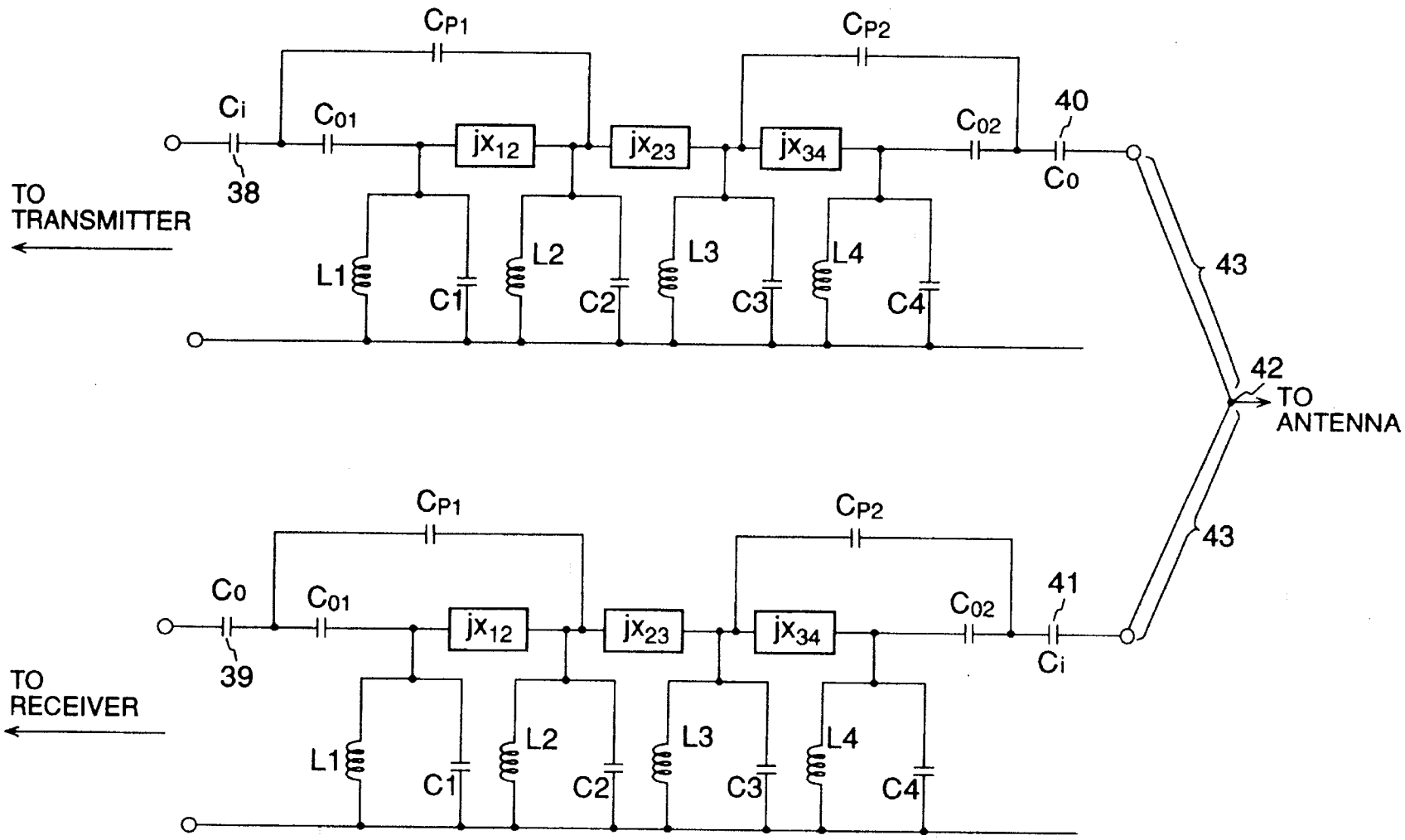
FIG. 22 is a diagram illustrating an equivalent circuit of the duplexer filter of FIG. 20.

FIG. 22 is a diagram illustrating an equivalent circuit of the duplexer filter shown in FIG. 20. In the both figures, CP1 represents over-coupling capacitors formed between the first and second layers. CP2 also represents over coupling capacitors formed between the first and second layers. Ci and Co represent capacitors 38 and 39 each coupling input and output terminals with the filters 33 and 34. C01 and C02 represent capacitors each coupling to resonators.

In summary, the strip line filter according to the invention has a structure which permits it to be formed in a considerably thinner size than that of a conventional dielectric filter, without excessive reduction in Q. The strip line filter can be formed as a compact, high performance polar filter, if the strip line filter is provided with a substrate formed with capacitors to provide attenuation poles. The strip line filter can be formed with the resonators having a height less than a quarter, equal to a quarter, or less than a half, of the wavelength corresponding to the resonance frequency, and can obtain the same effect as a strip line filter having short-circuited ends and a height equal to a quarter of the wavelength. Moreover, a duplexer filter has a thinner size and retains high performance, when such strip line filters are used for the transmitting filter and the receiving filter.

It is to be understood that although the present invention has been described in detail with respect to preferred embodiments thereof, various other embodiments and variations which fall within the scope and spirit of the invention, will be apparent to those skilled in the art, the scope of the invention being limited only by the following claims.

What is claimed is:

1. A strip line filter, comprising:

a rectangular box-shaped, dielectric block having opposite side faces, opposite front and back faces, and opposite top and bottom faces, said block having a plurality of parallel grooves in said front face, said grooves being formed with a predetermined spacing therebetween and extending from said top face to said bottom face;

an outer conductor formed of a thin film conductive material, covering said side faces, said back face, and said bottom face;

a plurality of resonators, each formed of a thin film of conductive material and covering the respective surfaces of said grooves, each of said resonators being connected to said outer conductor;

a plurality of resonant frequency adjusting electrodes connected to respective top ends of said resonators, said adjusting electrodes being disposed on said top face, adjacent to said outer conductor each of said adjusting electrodes producing a reactance component;

a substrate, disposed in parallel to one face of said dielectric block; and two capacitors, each having a pair of opposing electrodes formed on said substrate, one of said capacitors being connected to a first one of said resonators and the other of said capacitors being connected to a last one of said resonators.

2. A strip line filter as set forth in claim 1, wherein said one face of said dielectric block is the bottom face of said dielectric block.

3. A strip line filter as set forth in claim 1, wherein said one face of said dielectric block is the top face of said dielectric block.

4. A strip line filter as set forth in claim 1, wherein said one face of said dielectric block is the front face of said dielectric block.

5. A strip line filter, comprising:

a rectangular box-shaped, dielectric block having opposite side faces, opposite front and back faces, and opposite top and bottom faces, said block having a plurality of parallel grooves in said front face, said grooves being formed with a predetermined spacing therebetween and extending from said top face to said bottom face;

an outer conductor formed of a thin film conductive material, covering said side faces, said back face, and said bottom face;

a plurality of resonators, each formed of a thin film of conductive material and covering the respective surfaces of said grooves, each of said resonators being connected to said outer conductor;

a plurality of resonant frequency adjusting electrodes connected to respective top ends of said resonators, said adjusting electrodes being disposed on said top face, adjacent to said outer conductor, each of said adjusting electrodes producing a reactance component;

a substrate, disposed in parallel to one face of said dielectric block; and a plurality of coupling capacitors on said substrate, each having a pair of opposing electrodes formed on said substrate, said coupling capacitors being positioned next to each other and connected between adjacent pairs of said resonators.

6. A strip line filter, comprising;

a rectangular box-shaped, dielectric block having opposite side faces, opposite front and back faces, and opposite top and bottom faces, said block having a plurality of parallel grooves in said front rage, said grooves being formed with a predetermined spacing therebetween and extending from said top face to said bottom face;

an outer conductor formed of a thin film conductive material, covering said side faces, said back face, and said bottom face;

a plurality of resonators, each formed of a thin film of conductive material and covering the respective surfaces of said grooves, each of said resonators being connected to said outer conductor;

a plurality of resonant frequency adjusting electrodes connected to respective top ends of said resonators, said adjusting electrodes being disposed on said top face, adjacent to said outer conductor, each of said adjusting electrodes producing a reactance component;

a substrate, disposed in parallel to one face of said dielectric block; and a plurality of capacitors on said substrate, including first, second and third capacitors, each of said plurality of capacitors having a pair of opposing electrodes formed on said substrate, said plurality of capacitors being positioned next to each other and connected to respective ones of said resonators, said first capacitor having one side connected to a first one of said resonators, said second capacitor having one side connected to a last one of said resonators, and said third capacitor being connected between the other side of one of said first and second capacitors and one of the resonators adjacent to the resonator to which the one side of said one of said first and second capacitors is connected.

7. A strip line filter, comprising:

a rectangular box-shaped, dielectric block having opposite side faces, opposite front and back faces, and opposite top and bottom faces, said block having a plurality of parallel grooves in said front face, said grooves being formed with a predetermined spacing therebetween and extending from said top face to said bottom face;

an outer conductor formed of a thin film conductive material, covering said side faces, said back face, and said bottom face;

a plurality of resonators, each formed of a thin film of conductive material and covering the respective surfaces of said grooves, each of said resonators being connected to said outer conductor;

a substrate, disposed in parallel to one face of said dielectric block; and two capacitors, each having a pair of opposing electrodes formed on said substrate, one of said two capacitors being connected to a first one of said resonators and the other of said two capacitors being connected to a last one of said resonators.

8. A strip line filter, comprising:

a rectangular box-shaped, dielectric block having opposite side faces, opposite front and back faces, and opposite top and bottom faces, said block having a plurality of parallel grooves in said front face, said grooves being formed with a predetermined spacing therebetween and extending from said top face to said bottom face;

an outer conductor formed of a thin film conductive material, covering said side faces, said back face, and said bottom face;

a plurality of resonators, each formed of a thin film of conductive material and covering the respective surfaces of said grooves, each of said resonators being connected to said outer conductor;

a substrate, disposed in parallel to one face of said dielectric block; and a plurality of coupling capacitors, each having a pair of opposing electrodes formed on said substrate, said plurality of coupling capacitors being positioned next to each other and connected between adjacent pairs of said resonators.

9. A strip line filter as set forth in claim 8, wherein said one face of said dielectric group is the bottom face of said dielectric block.

10. A strip line filter as set forth in claim 8, wherein said one face of said dielectric block is the top face of said dielectric block.

11. A strip line filter as set forth in claim 8, wherein said one face of said dielectric block is the front face of said dielectric block.

12. A strip line filter, comprising:

a rectangular box-shape, dielectric block having opposite side faces, opposite front and back faces, and opposite top and bottom faces, said block having a plurality of parallel grooves in said front face, said grooves being formed with a predetermined spacing therebetween and extending from said top face to said bottom face;

an outer conductor formed of a thin film conductive material, covering said side faces, said back face, and said bottom face;

a plurality of resonators, each formed of a thin film of conductive material and covering the respective surfaces of said grooves, each of said resonators being connected to said outer conductor;

a substrate, disposed in parallel to one face of said dielectric block; and a plurality of capacitors, each having a pair of opposing electrodes formed on said substrate, said capacitors being positioned next to each other and connected to respective ones of said resonators, said plurality of capacitors including a first capacitor having one side connected to a first one of said resonators, a second capacitor having one side connected to a last one of said resonators, and a third capacitor connected between the other side of one of said first and second capacitors and one of the resonators adjacent to the resonator to which the one side of said one of said first and second capacitors is connected.

13. A strip line filter as set forth in claim 12, wherein said third capacitor is connected between the other side of said second capacitor and the resonator adjacent to the last resonator, said plurality of capacitors further comprising a fourth capacitor connected between the other side of said first capacitor and the resonator adjacent to the first resonator, said third and fourth capacitors forming over-coupling capacitors operative to produce attenuation poles at finite frequencies.

14. A strip line filter, comprising:

a rectangular box-shaped, dielectric block having opposite side faces, opposite front and back faces, and opposite top and bottom faces, said block having a plurality of parallel grooves in said front face, said grooves being formed with a predetermined spacing therebetween and extending from said top face to said bottom face;

an outer conductor formed of a thin film conductive material, covering said side faces, said back face, and said bottom face;

a plurality of resonators, each formed of a thin film of conductive material and covering the respective surfaces of said grooves, each of said resonators being connected to said outer conductor;

a substrate, disposed in parallel to one face of said dielectric block; and a plurality of capacitors, each having a pair of opposing electrodes formed on said substrate, said plurality of capacitors being positioned next to each other and including a first capacitor having one side connected to a first one of said resonators, a second capacitor having one side connected to a last one of said resonators, a third capacitor connected between the one side of said first capacitor and the resonator adjacent to the first resonator, and a fourth capacitor connected between the other side of said second capacitor and the resonator adjacent to the last resonator.

15. A duplexer filter, comprising: a transmitting filter and a receiving filter, each comprising a strip line filter, including a rectangular box-shaped, dielectric block having opposite side faces, opposite front and back faces, and opposite top and bottom faces, said block having a plurality of parallel grooves, formed with a predetermined spacing therebetween and extending from said top face to said bottom face, an outer conductor formed of a thin film conductive material, covering said side faces, said back face, and said bottom face, a plurality of resonators, each formed of a thin film of conductive material and covering the respective surfaces of said grooves, each to said resonators being connected to said outer conductor, a substrate, disposed in parallel to one face of said dielectric block, and a plurality of capacitors, each having a pair of opposing electrodes formed on said substrate, said capacitors being positioned next to each other and connected to respective ones of said resonators, said plurality of capacitors including a first capacitor having one side connected to a first one of said resonators, a second capacitor having one side connected to a last one of said resonators, and a third capacitor connected between the other side of one of said first and second capacitors and one of the resonators adjacent to the resonator to which the one side of said one of said first and second capacitors is connected; and a separating circuit connected to said transmitting and receiving filters so as to convey a transmit signal from said transmitting filter to an antenna and to convey a receive signal from the antenna to said receiving filter, said separate circuit including a substrate and circuitry thereon, formed by a strip line; wherein the substrates of said transmitting filter and said receiving filter are disposed adjacent to said substrate of said separating circuit.

16. A duplexer filter as set forth in claim 15, wherein the substrates of said transmitting filter, said receiving filter, and said separating circuit are formed in a common multilayer substrate.

17. A duplexer filter, comprising:

a transmitting filter and a receiving filter, each comprising a strip line filter, said transmitter filter and receiving filter having in common a rectangular box-shaped, dielectric block having opposite side faces, opposite front and back faces, and opposite top and bottom faces, said block having first and second adjacent sets of parallel grooves, the grooves of each set having a predetermined spacing therebetween and extending from said top face to said bottom face, and an outer conductor formed of a thin film conductive material, covering said side faces, said back face, and said bottom face; said filters each including a plurality of resonators, each formed of a thin film of conductive material and covering the respective surfaces of said grooves, each of said resonators being connected to said outer conductor, a substrate, disposed in parallel to one face of said dielectric block, and a plurality of capacitors, each having a pair of opposing electrodes formed on said substrate, said capacitors being positioned next to each other and connected to respective ones of said resonators, said plurality of capacitors including a first capacitor having one side connected to a first one of said resonators, a second capacitor having one side connected to a last one of said resonators, and a third capacitor connected between the other side of one of said first and second capacitors and one of the resonators adjacent to the resonator to which the one side of said one of said first and second capacitors is connected; and a separating circuit connected to said transmitting and receiving filters to as to convey a transmit signal from said transmitting filter to an antenna and to convey a receive signal from the antenna to said receiving filter, said separating circuit including a substrate and circuitry thereon, formed by a strip line;

wherein the substrates of said transmitting filter, said receiving filter, and said separating circuit are formed in a common multilayer substrate, the substrates of said transmitting filter and said receiving filter being disposed adjacent to the substrate of said separating circuit.

18. A strip line filter, comprising:

a rectangular box-shaped, dielectric block having opposite side faces, opposite front and back faces, and opposite tip and bottom faces, said block having a plurality of parallel grooves in said front face, said grooves being formed with a predetermined spacing therebetween and extending from said too, face to said bottom face;

an outer conductor formed of a thin film conductive material, covering said side faces, said back faces, and said bottom face;

a plurality of resonators, each formed of a think film of conductive material and covering the respective surfaces of said grooves, each of said resonators being connected to said outer conductor; and a strip electrode disposed between an adjacent pair of said resonators, said strip electrode being located on said top face, one end of said strip electrode being connected to said outer conductor.

19. A strip line filter, comprising;

a rectangular box-shaped, dielectric block having opposite side faces, opposite front and back faces, and opposite top and bottom faces, said block having a plurality of parallel grooves in said front face, said grooves being formed with a predetermined spacing therebetween and extending from said top face to said bottom face;

an outer conductor formed of a thin film conductive material, covering said side faces, said back face, and said bottom face;

a plurality of resonators, each formed of a thin film of conductive material and covering the respective surfaces of said grooves, each of said resonator being connected to said outer conductor;

a substrate, disposed in parallel to one of said front, top and bottom faces of said dielectric block, and a plurality of coupling capacitors on said substrate, each having a pair of opposing electrodes formed on opposite sides of said substrate, said coupling capacitors being positioned next to each other and connected to said resonators.

20. A strip line filter, comprising:

a rectangular box-shaped, dielectric block having opposite side faces, opposite front and back faces, and opposite top and bottom faces, said block having a plurality of parallel grooves in said front face, said grooves being formed with a predetermined spacing therebetween and extending from said top face to said bottom face;

an outer conductor covering said side faces, said back face, and said bottom face;

a plurality of resonators, each including conductive material covering the surface of a respective one of said grooves, each of said resonators being connected to said outer conductor;

a plurality of resonant frequency adjusting means, formed on said dielectric block and connected to respective top ends of said resonators, for adjusting a resonant frequency of said resonators, each of said adjusting means being disposed adjacent to said outer conductor and producing a reactance component;

reactance coupling means, for producing a reactance coupling between an adjacent pair of said resonators;

input/output coupling means for producing reactance coupling with a first one and a last one of said resonators; and a substrate opposing said dielectric block, at least one of said reactance coupling means and said input/output coupling means being disposed on said substrate.

21. A strip line filter according to claim 20, wherein said substrate opposes said front face in parallel relation thereto.

22. A strip line filter according to claim 20, wherein said reactance coupling means is disposed on said dielectric block.

* * * * *